US011661941B2

(12) United States Patent
Mehta et al.

(10) Patent No.: US 11,661,941 B2
(45) Date of Patent: May 30, 2023

(54) SOUND CONTROL FOR A HEATING, VENTILATION, AND AIR CONDITIONING UNIT

(71) Applicant: TRANE INTERNATIONAL INC., Davidson, NC (US)

(72) Inventors: Pavak Mehta, La Crescent, MN (US); William B. Rockwood, Onalaska, WI (US); Timothy G. Garvin, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 17/712,266

(22) Filed: Apr. 4, 2022

(65) Prior Publication Data

US 2022/0220961 A1 Jul. 14, 2022

Related U.S. Application Data

(63) Continuation of application No. 16/983,698, filed on Aug. 3, 2020, now Pat. No. 11,293,441, which is a continuation of application No. 14/936,306, filed on Nov. 9, 2015, now Pat. No. 10,731,648.

(60) Provisional application No. 62/076,639, filed on Nov. 7, 2014.

(51) Int. Cl.
*F04C 29/06* (2006.01)
*F04C 18/16* (2006.01)

(52) U.S. Cl.
CPC ..... *F04C 29/065* (2013.01); *F04C 18/16* (2013.01); *F04C 2270/125* (2013.01)

(58) Field of Classification Search
CPC ... F04C 18/16; F04C 2270/125; F04C 29/065
See application file for complete search history.

(56) References Cited

U.S. PATENT DOCUMENTS

| | | | |
|---|---|---|---|
| 282,967 | A | 8/1883 | Duffy |
| 350,422 | A | 10/1886 | Duffy |
| 4,508,486 | A | 4/1985 | Tinker |
| 5,183,974 | A | 2/1993 | Wilhem et al. |
| 5,252,035 | A | 10/1993 | Lee |
| 5,272,285 | A | 12/1993 | Miller |

(Continued)

FOREIGN PATENT DOCUMENTS

| | | |
|---|---|---|
| CN | 201193902 | 2/2009 |
| CN | 201589393 | 9/2010 |

(Continued)

OTHER PUBLICATIONS

International search report for International application No. PCT/US2013/050065, dated Oct. 1, 2013 (3 pages).

(Continued)

*Primary Examiner* — Henry T Crenshaw
(74) *Attorney, Agent, or Firm* — Hamre, Schumann, Mueller & Larson, P.C.

(57) ABSTRACT

Systems and methods to isolate a vibration source (e.g., a compressor) externally are disclosed. The embodiments generally include preventing/reducing vibration and/or pulsation transmission from the vibration source by one or more functional/structural isolating members, and preventing/reducing sound radiated from the vibration source by one or more sound enclosures.

6 Claims, 5 Drawing Sheets

(56) References Cited

U.S. PATENT DOCUMENTS

| | | | | |
|---|---|---|---|---|
| 5,274,200 | A | 12/1993 | Das et al. | |
| 5,588,810 | A | 12/1996 | Diflora et al. | |
| 5,694,926 | A | 12/1997 | DeVries et al. | |
| 5,791,696 | A | 8/1998 | Miyajima et al. | |
| 5,804,775 | A | 9/1998 | Pinnington | |
| 5,997,258 | A | 12/1999 | Sawyer et al. | |
| 6,062,033 | A | 5/2000 | Choi | |
| 6,116,374 | A | 9/2000 | Westerbeke, Jr. | |
| 6,145,616 | A | 11/2000 | Ewanek | |
| 6,260,373 | B1 | 7/2001 | Rockwood | |
| 6,322,339 | B1 | 11/2001 | Mitsunaga et al. | |
| 6,414,323 | B1 | 7/2002 | Abe et al. | |
| 7,278,834 | B2 | 10/2007 | Herrick et al. | |
| 7,318,608 | B2 | 1/2008 | Swartz et al. | |
| 7,357,219 | B2 | 4/2008 | Mafi et al. | |
| 7,526,903 | B2 | 5/2009 | Kandasamy | |
| 7,845,463 | B2 | 12/2010 | Yabe et al. | |
| 3,061,475 | A1 | 11/2011 | Mori et al. | |
| 8,100,127 | B2 | 1/2012 | Worley | |
| 8,459,963 | B2 | 6/2013 | Pileski | |
| 9,423,149 | B2 | 8/2016 | Martinus | |
| 2005/0006895 | A1* | 1/2005 | Muroi | F16L 27/11 285/299 |
| 2005/0167189 | A1 | 8/2005 | Aisenbrey | |
| 2005/0223725 | A1 | 10/2005 | Crane et al. | |
| 2005/0274569 | A1 | 12/2005 | Seel | |
| 2006/0144637 | A1 | 7/2006 | Swartz et al. | |
| 2006/0283657 | A1 | 12/2006 | Dubensky et al. | |
| 2007/0116584 | A1* | 5/2007 | DeRosa | F04C 18/16 417/442 |
| 2007/0169504 | A1 | 7/2007 | Vinocur | |
| 2008/0099274 | A1 | 5/2008 | Seel | |
| 2008/0099275 | A1 | 5/2008 | Seel | |
| 2009/0065299 | A1 | 3/2009 | Vito et al. | |
| 2009/0159581 | A1* | 6/2009 | Sommerfeld | B23K 9/32 219/133 |
| 2009/0309355 | A1 | 12/2009 | Turfait et al. | |
| 2010/0070085 | A1 | 3/2010 | Harrod et al. | |
| 2010/0116583 | A1 | 5/2010 | Seedorf | |
| 2011/0017544 | A1 | 1/2011 | Bodwell et al. | |
| 2011/0067949 | A1 | 3/2011 | Mori et al. | |
| 2012/0193505 | A1 | 8/2012 | Baron | |
| 2012/0251357 | A1 | 10/2012 | Yokoi et al. | |
| 2012/0279245 | A1 | 11/2012 | Subramaniam et al. | |
| 2013/0028758 | A1 | 1/2013 | Nemit, Jr. et al. | |
| 2013/0136626 | A1* | 5/2013 | Yang | F04C 29/068 417/312 |
| 2013/0312433 | A1 | 11/2013 | Nemit, Jr. | |
| 2014/0050572 | A1 | 2/2014 | Mehta et al. | |
| 2014/0212311 | A1 | 7/2014 | Moseley et al. | |
| 2015/0192310 | A1* | 7/2015 | Mehta | F16F 15/02 285/119 |
| 2015/0345497 | A1 | 12/2015 | Lucas et al. | |
| 2016/0131139 | A1 | 5/2016 | Mehta et al. | |

FOREIGN PATENT DOCUMENTS

| | | |
|---|---|---|
| EP | 2006591 | 12/2008 |
| JP | 55-45084 | 3/1980 |
| JP | 2007-035043 | 2/1995 |
| JP | 2000-199482 | 7/2000 |
| JP | 2000-240982 | 9/2000 |
| JP | 2009-293905 | 12/2009 |
| KR | 20-1990-0001060 | 2/1990 |
| KR | 10-2003-0050932 | 6/2003 |
| KR | 20-0390456 | 7/2005 |
| KR | 10-866173 | 10/2008 |

OTHER PUBLICATIONS

Written opinion for International application No. PCT/US2013/050065, dated Oct. 1, 2013 (7 pages).

International search report for International application No. PCT/US2013/055601, dated Dec. 17, 2013, (3 pgs).

Written opinion for International application No. PCT/US2013/055601, dated Dec. 17, 2013, (8 pgs).

U.S. Non-final Office Action for U.S. Appl. No. 13/970,325, dated Oct. 7, 2015, 16 pgs.

U.S. Non-final Office Action for U.S. Appl. No. 14/422,138, dated Aug. 21, 2015, 12 pgs.

U.S. Non-final Office Action for U.S. Appl. No. 14/422,138, dated Dec. 16, 2015, 16 pgs.

U.S. Non-final Office Action for U.S. Appl. No. 14/422,138, dated May 6, 2016 (19 pages).

U.S. Final Office Action for U.S. Appl. No. 14/422,138, dated Sep. 8, 2016 (20 pages).

* cited by examiner

SOUND CONTROL FOR A HEATING, VENTILATION, AND AIR CONDITIONING UNIT

FIELD

This disclosure relates to sound control of a vibration source, such as, for example, a compressor in a chiller of a heating, ventilation, and air conditioning (HVAC) unit and/or system. More specifically, the disclosure relates to systems and methods to isolate the vibration source externally to control operational sound of the vibration source.

BACKGROUND

One of the major vibration sources in a refrigeration system (e.g., a chiller system) is a compressor. Vibration of the compressor can be transmitted to other functional components (e.g., refrigerant pipes) or structural components (e.g., a compressor supporting structure) connected to the compressor, causing operational sound. The vibration of the compressor can also radiate to create sound.

SUMMARY

Systems and methods to isolate a vibration source externally to control sound from the vibration source (e.g., a compressor) are described.

In some embodiments, an external isolation system for a vibration source may include a sound enclosure configured to surround the vibration source to reduce sound radiated from the vibration source. In some embodiments, the external isolation system may include a structural isolating member configured to support the vibration source to reduce vibration transmission from the vibration source to a structural component. In some embodiments, the external isolation system may include a functional isolating member to reduce vibration/pulsation transmission from the vibration source to a functional component. The functional isolating member may be positioned between the vibration source and the functional component and maintain a functional connection (e.g., form a fluid communication) between the vibration source and the functional component so that the vibration source and the functional component can function properly.

In some embodiments, the functional isolating member may include a muffler installed to a working fluid port of the vibration source. The muffler may help reduce pulsation carried in the working fluid. In some embodiments, the functional isolating member may include an isolating conduit having a bellow-like structure, which may help reduce vibration/pulsation transmission between the vibration source and the functional component.

In some embodiments, a method of providing external sound control to a vibration source may include reducing vibration/pulsation transmission between a vibration source and a functional component; reducing vibration transmission between the vibration source and a structural component that supports the vibration source; and reducing sound radiated from the vibration source.

An external isolation system for a heating, ventilation, and air conditioning (HVAC) unit is disclosed. The system includes a sound enclosure configured to surround a compressor so as to reduce sound radiated from the compressor; a structural isolating member configured to support the compressor and actively damp vibrations and/or pulsations; and a functional isolating member configured to maintain a functional connection with the compressor.

Other features and aspects of the systems and methods will become apparent by consideration of the following detailed description and accompanying drawings.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

A compressor in a refrigeration and/or an HVAC unit or system (e.g., a chiller) is one of the major vibration sources. There are various types of compressors. Some types of compressors may have more vibration than the other types. For example, a screw compressor may typically have a relatively high level of vibration during operation.

The vibration can cause operational sound, or can be transmitted to one or more functional components that are functionally connected to the compressor, such as, for example, a refrigerant pipe, or one or more structural components that are structurally connected to the compressor, such as, for example, a compressor support and/or frame. The functional and/or structural components can be relatively rigid. The functional and/or structural components themselves generally do not contribute to vibrations and sound. However, through the vibration source, e.g., a compressor, the functional and/or structural components can contribute to vibration transmission and operational sound. Improvements can be made to reduce vibration transmission and operational sound.

Embodiments disclosed in this specification are directed to systems and methods to isolate a vibration source (e.g., a compressor) externally with respect to the vibration source. The embodiments disclosed may generally include preventing/reducing vibration and/or pulsation transmission from the vibration source by one or more functional/structural isolating members, and preventing/reducing sound radiated from the vibration source by one or more sound enclosures.

References are made to the accompanying drawings that form a part hereof, and in which is shown by way of illustration, embodiments that may be practiced. It is to be understood that the terms used are for describing the figures and embodiments and should not be regarded as limiting in scope.

Figure 1:
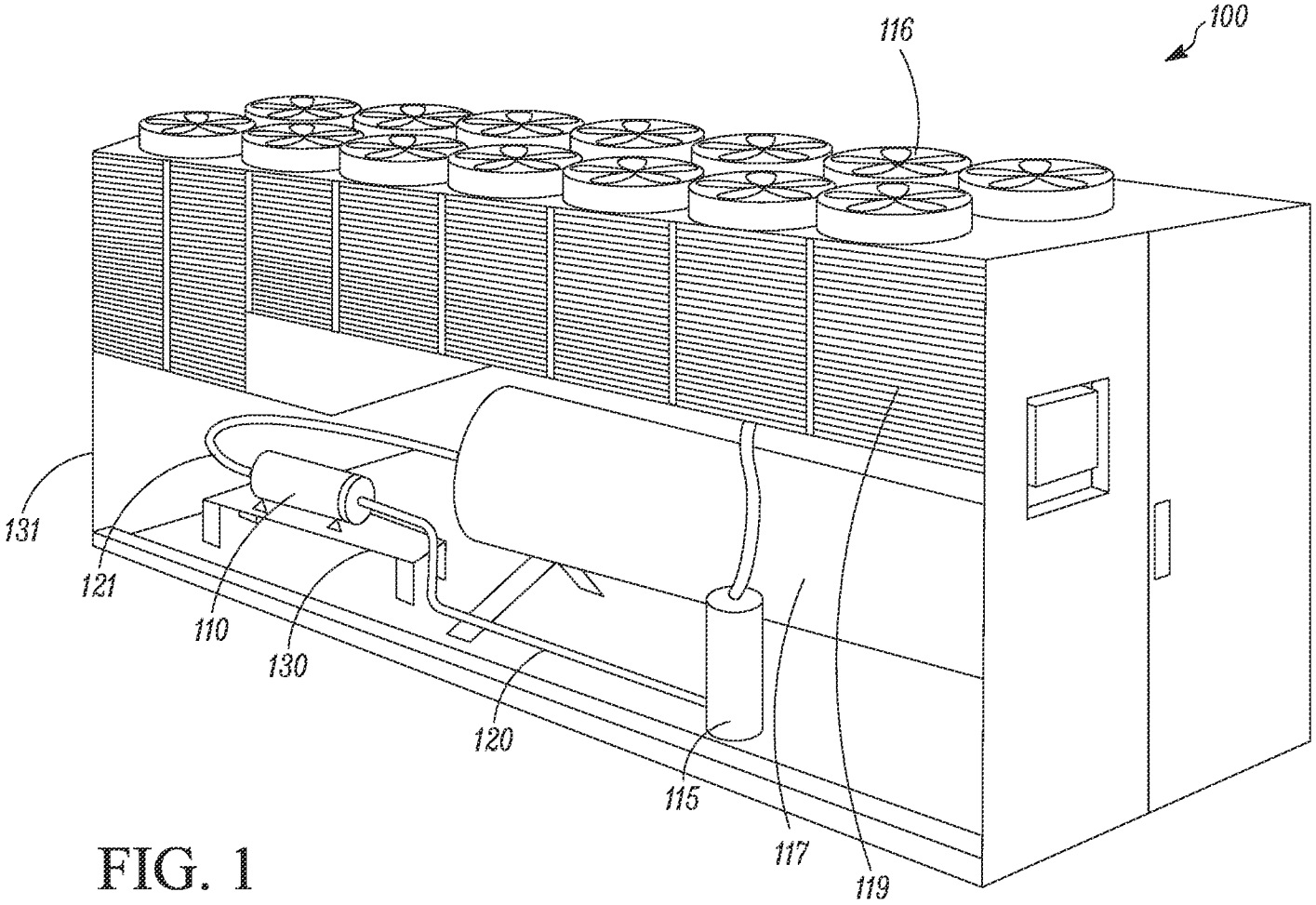
FIG. 1 illustrates a chiller, with which the embodiments as disclosed herein can be practiced.

FIG. 1 illustrates an example of a chiller system 100. The chiller system 100 includes a compressor 110 and other functional components such as, for example, an oil separator 115, a condenser coil(s) 119, an evaporator 117, and one or more fans 116. The chiller system 100 can also include structural components, such as, for example, a support 130 for the compressor 10 and a frame 131. It is to be understood that some components can be both structural and functional.

In operation, the compressor 110 can compress a refrigerant vapor. The compressed refrigerant can flow into the condenser coil 119 through a discharge refrigerant line 120. In the condenser coil 119, the compressed refrigerant vapor can release heat and become liquid refrigerant. The liquid refrigerant can then flow into the evaporator 117, in which the liquid refrigerant can absorb heat from a medium (e.g., water). The refrigerant liquid can be vaporized during the process. The refrigerant vapor can then flow back to the compressor 110 through a suction refrigerant line 121.

In operation, the compressor 110 can produce vibration. Some compressors, such as a screw type compressor, may have a relatively high level of vibration. Vibration can create sound that may be radiated in the air, and can be transmitted to other structural/functional components of the chiller system 100.

Compression of the refrigerant by the compressor 110 can also produce pulsation. The pulsation can be carried by the refrigerant from the compressor 110 to other structural/functional components of the chiller system 100 through, for example, refrigerant pipes (e.g., the discharge refrigerant pipe 120 and the suction refrigerant pipe 121). Pulsation carried by the refrigerant can also result in operational sound.

The refrigerant lines, e.g., the discharge refrigerant line 120 and the suction refrigerant line 121, are relatively rigid, so the refrigerant lines can withstand a relatively high pressure. In addition, the structural components, such as for example the support 130 for the compressor 110 or the frame 131 of the chiller system 100 can also be relatively rigid. These relatively rigid structural/functional components may transmit vibration/pulsation relatively easily, and can produce sound due to vibration.

Generally, operational sounds related to a compressor in a chiller system may be due to: vibration and radiated sound from the compressor; transmission of the vibration from the compressor to other structural/functional components of the chiller system; pulsation due to compression of the refrigerant; and/or transmission of the pulsation from the compressor to other structural/functional components of the chiller system. Reducing the vibration/pulsation transmission and radiated sound can help reduce the operational sound of the compressor.

Figure 2:
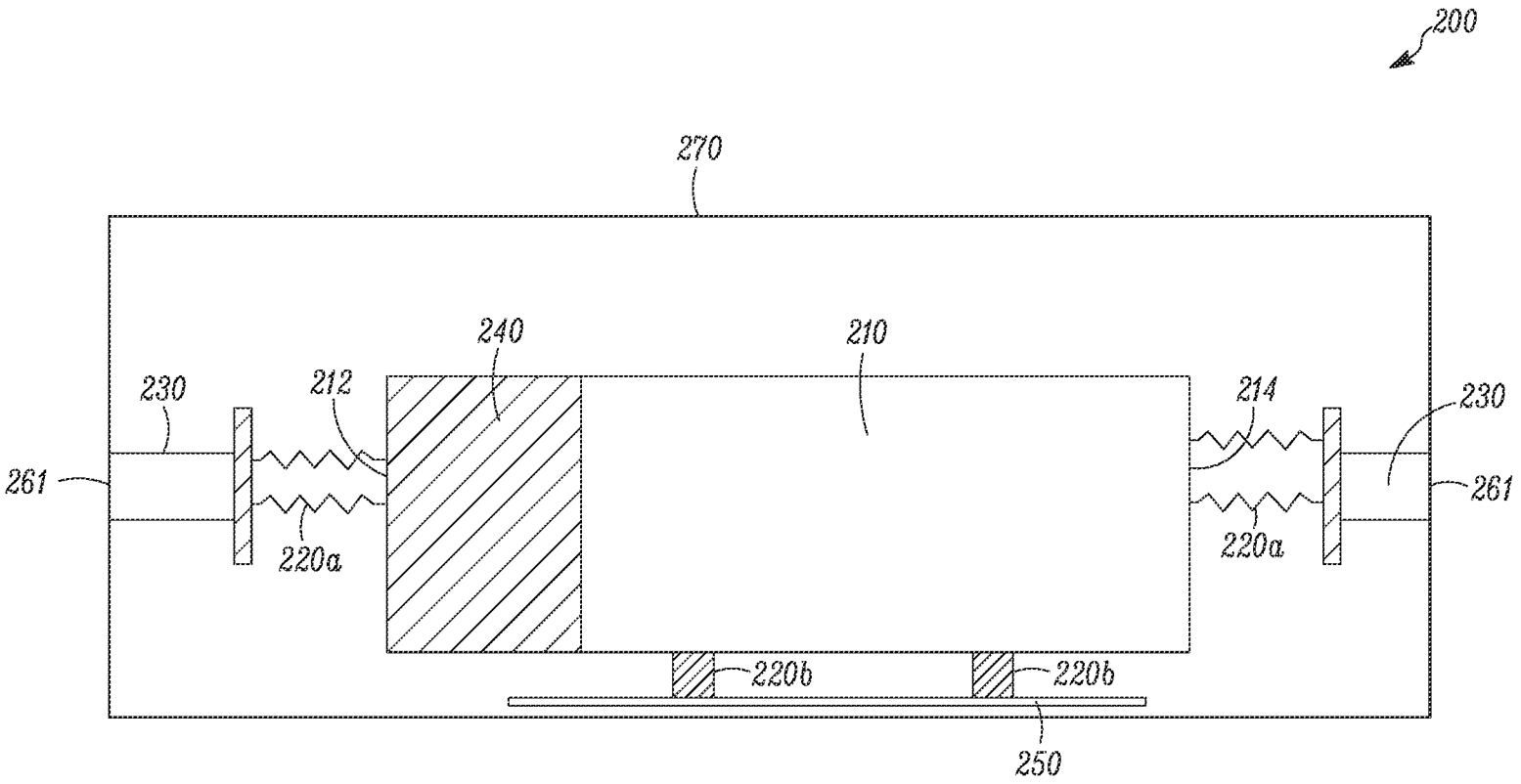
FIG. 2 is a schematic diagram of an external isolation system, according to an embodiment.

FIG. 2 illustrates a schematic diagram of an external isolation system 200 that is configured to help isolate the vibration source 210 (e.g., a compressor) so as to reduce vibration/pulsation transmission and radiated sound originated from a vibration source 210.

As illustrated, the external isolation system 200 includes one or more features that are configured to prevent and/or reduce vibration transmission, pulsation transmission, and/or sound radiated from the vibration source 210. The external isolation system 200 may include one or more isolating members (e.g., an isolating conduit 220*a* and an isolating support member 220*b*). The term "isolating member" generally refers to a structure or a device that is configured to prevent and/or reduce vibration and/or pulsation transmission along (e.g., from one end to the other end of) the structure or device. Generally, the isolating member can include a functional isolating member and a structural isolation member. The functional isolation member is generally positioned between the vibration source 200 and a functional component (e.g., a refrigerant line 230). The functional isolation member is configured to maintain a functional connection between the vibration source and the functional component so that the vibration source and the functional component can function properly (e.g., direct a refrigerant flow), while preventing/reducing vibration/pulsation transmission between the vibration source and the functional component. The term "functional connection" refers to a connection between two functional components that can maintain the proper function between the two functional components, such as, for example, forming a fluid communication to direct a fluid, is part of the fluid circuit, and/or is otherwise involved in the operation of the unit. The functional connection may be used to maintain the operation of the two functional components. For example, in a chiller system, a functional connection may refer to forming a refrigerant fluid communication between two functional components (e.g., a compressor and a refrigerant line).

The isolating member can also include a structural isolating member. The structural isolation member is generally not involved with operation of the unit (e.g., directing or handling of the fluid, such as in compression of a refrigerant gas). The structural isolating member is generally positioned between the vibration source and another structural component. Even though the structural isolating member may not be critical for the vibration source to function properly, the structural isolation member can help prevent and/or reduce vibration/pulsation transmission between the vibration source and the structural component.

The isolating member can include a passive vibration and/or pulsation damping structure/device. A passive vibration and/or pulsation damping structure/device may be a structure/device that is configured to damp, reduce, or prevent transmission of the vibration/pulsation energy passively. The isolating member can also include an active vibration and/or pulsation damping structure/device. An active vibration and/or pulsation damping structure/device may be a structure/device that can actively generate a vibration/pulsation energy that can cancel (or counter) the vibration and/or pulsation energy from the vibration source.

For example, in some embodiments, the isolating member may include a flexible/elastic region or structure (e.g., the isolating conduit 220*a*) that can damp the vibration and/or pulsation in a passive manner. In some embodiments, the isolating member may include a muffler that can help damp the pulsation carried in the compressed refrigerant passively.

In some embodiments, the isolating member may include an actuator that is configured to generate a vibration/pulsation actively that is out of phase with respect to the vibration/pulsation from the vibration source 210 to attenuate the vibration/pulsation from the vibration source 210.

In the illustrated embodiment, the functional isolating member includes the isolating conduit 220*a*, which includes a conduit that allows a working fluid to flow through (e.g., the functional aspect of the isolating conduit 220*a*). The isolating conduit 220*a* can be generally configured to prevent and/or reduce vibration/pulsation carried by the working fluid (e.g., refrigerant) from being transmitted across the conduit. The isolating conduit 220*a* can also be generally configured to prevent and/or reduce vibration/pulsation from being transmitted along (e.g., from one end to the other end of) the isolating conduit 220*a*. In some embodiments, for example, the isolating conduit 220*a* may include a bellow-like structure. The isolating conduit 220*a* can be installed between a refrigerant pipe 230 and a working fluid port (e.g. a discharge port 212 or a suction port 214) of the vibration source 210. The isolating conduit 220*a* can help prevent and/or reduce vibration/pulsation transmission between the vibration source 210 and the refrigerant pipe 230, while allowing the working fluid to flow through. It is to be understood that the configuration (e.g., material, structure, construction, and configuration) of the isolating conduit

220*a* on the discharge port 212 and the isolating conduit 220*a* on the suction port 212 can be the same or different. For example, the isolating conduit 220*a* installed on the suction port 214, in some embodiments, may be configured to withstand a pressure that is lower than the isolating conduit 220*a* installed on the discharge port 212.

The external isolation system 200 can also include a muffler 240 that is installed on the discharge port 212 of the vibration source 210, with the notion that a muffler can also be installed on the suction port 214 of the vibration source 210. In some embodiments, the muffler can be integrated as part of or with the vibration source (e.g., a compressor), and can be installed inside the enclosure 270. The muffler 240 can help prevent and/or reduce pulsation carried in the working fluid (e.g. refrigerant).

Generally, the isolating conduit 220*a* and the muffler 240 are functional isolating members that incorporate a structure/device configured to maintain a functional connection between the vibration source 210 and one or more other functional components (e.g., the refrigerant pipe 230), while helping prevent/reducing vibration/pulsation transmission between the vibration source 210 and the other functional components. The designs of these functional isolating members can be varied to satisfy the functional requirements, and generally may include a portion to satisfy the requirement of making a functional connection, and a portion to help reduce vibration/pulsation transmission.

The vibration source 210 can be generally supported by the isolating support member 220*b* (e.g., a structural isolating member), which can help prevent and/or reduce the vibration of the vibration source 210 from being transmitted to a structural component 250 (e.g., the frame 131 of the chiller system 100) that supports the vibration source 210. In some embodiments, the isolating support member 220*b* can include, for example, an elastic member (e.g., rubber). In some embodiments, the elastic member can be made of neoprene. In some embodiments, the isolating support member 220*b* can be an active vibration/pulsation damping device.

The external isolating system 200 can also include a sound enclosure 270 that is configured to generally surround the vibration source 210, which can help prevent and/or reduce radiated sound created by the vibration source 210. The sound enclosure 270 can, for example, include structure having a sound absorption material surrounded by a sound reflective material.

In the illustrated embodiment, the isolating members are generally surrounded by the sound enclosure 270. This is exemplary. It is understood that the isolating members, including the isolating conduit 220*a*, the attached refrigerant pipes 230, and the isolating support member 220*b*, can extend out of the sound enclosure 270. In some embodiments, the sound enclosure 270 may include one or more openings 261 that allows the isolating conduit 220*a* or the attached refrigerant pipes 230 to extend out of the sound enclosure 270 through the openings 261.

Figure 3A:
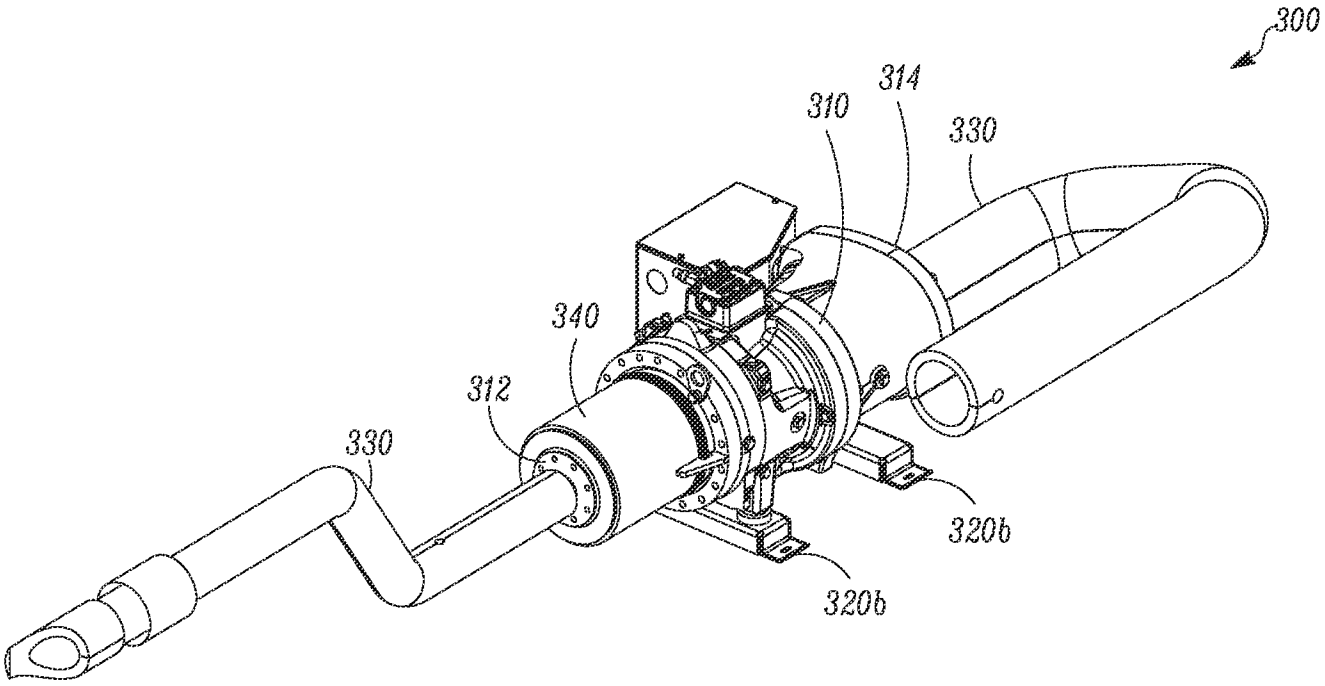
FIGS. 3A-3B illustrate an external isolation system, according to an embodiment.
Figure 3B:
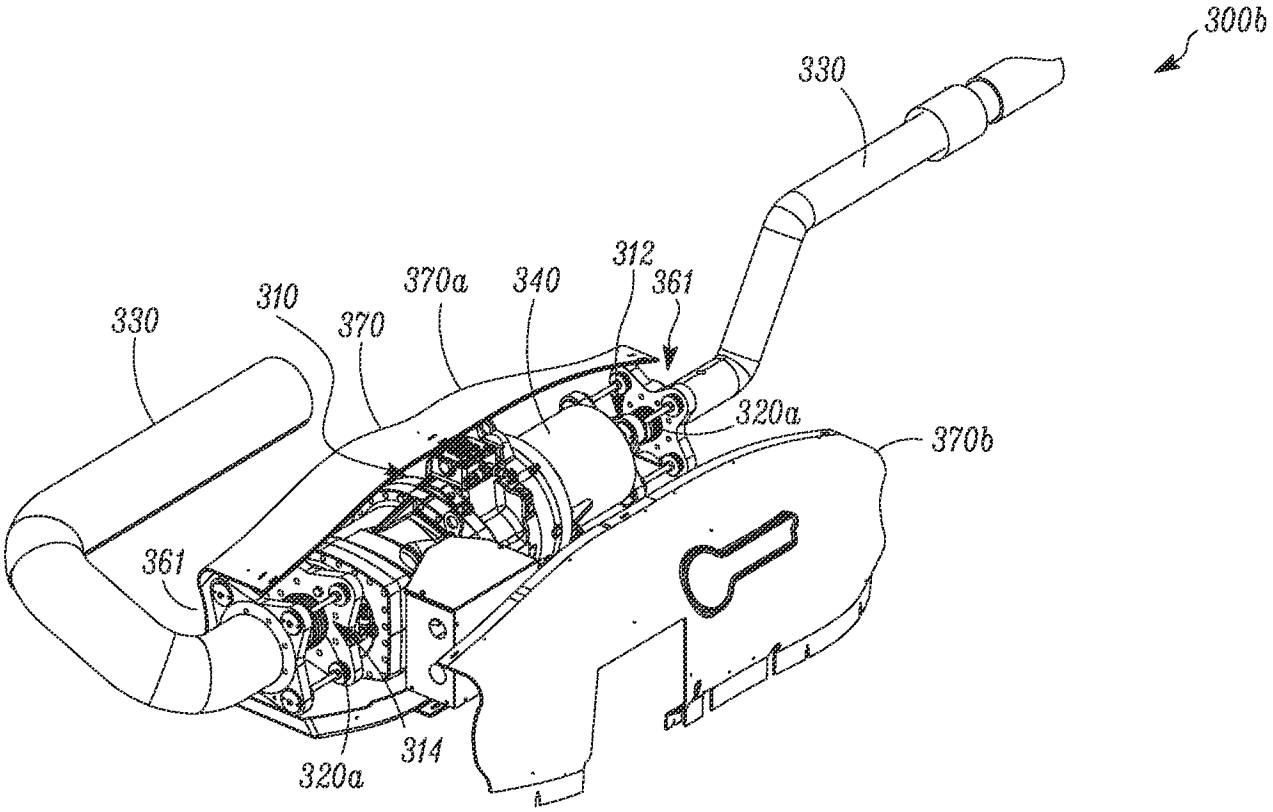

FIGS. 3A-3B illustrate an external isolation system, according to an embodiment. FIG. 3A illustrates external isolation system 300 while FIG. 3B illustrates external isolation system 300*b*. Aspects of FIG. 3A can be the same as or similar to aspects of FIG. 3B. For simplicity of this specification, features common to both FIG. 3A and FIG. 3B will be described with reference to FIG. 3A.

The external isolation system 300 of FIG. 3A includes a compressor 310. The compressor 310 may generally be a vibration source (e.g., vibration source 210 of FIG. 2). The external isolation system 300 includes a muffler 340. Refrigerant may be discharged from the compressor 310 via the muffler 340 at a discharge port 312 and provided to a refrigerant pipe 330. Refrigerant may be provided to a suction port 314 of the compressor 310 via refrigerant pipe 330. The external isolation system 300 includes a plurality of isolating support members 320*b* (e.g., structural isolating member 220*b* of FIG. 2). The isolating support members 320*b* can prevent and/or reduce vibrations from the compressor 310 from being transmitted to a structural component (e.g., the frame of the chiller system 100 of FIG. 1).

The external isolation system 300*b* of FIG. 3B additionally includes isolating conduits 320*a* (e.g., isolating conduit 220*a* of FIG. 2). The isolating conduits 320*a* can be disposed between, for example, the refrigerant pipe 330 and the suction port 314 on an inlet side of the compressor 310 and between the refrigerant pipe 330 and the discharge port 312 on the outlet side of the compressor 310. The external isolation system 300*b* additionally includes a sound enclosure 370 (e.g., the sound enclosure 270 of FIG. 2). The illustrated sound enclosure 370 includes a two-piece construction, and includes a first sound enclosure member 370*a* and a second sound enclosure member 370*b*. It will be appreciated that the number of members of the sound enclosure 370 is intended to be an example and that other numbers of members of the sound enclosure 370 are within the scope of this disclosure.

Figure 4:
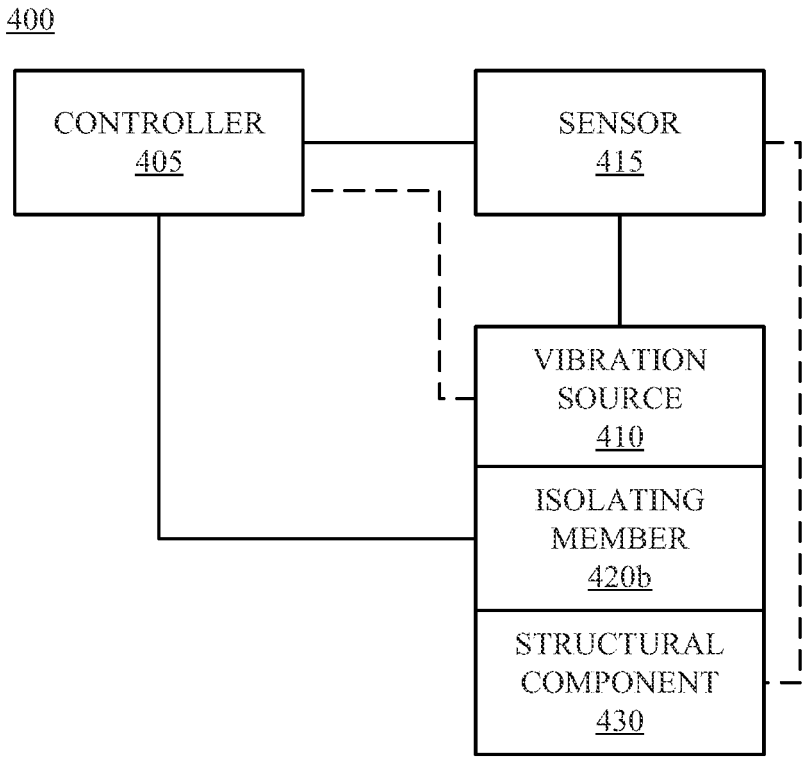
FIG. 4 is a schematic diagram of a system including an isolating member that is an active vibration and/or pulsation damping device, according to an embodiment.

FIG. 4 is a schematic diagram of a system 400 including an isolating member 420*b* that is an active vibration and/or pulsation damping device, according to an embodiment. It will be appreciated that the system 400 can include one or more other components. For example, the system 400 can include an isolating member that is a passive vibration and/or pulsation damping device, or the like.

The system 400 includes a controller 405, a vibration source 410, a sensor 415, and the isolating member 420*b*. The isolating member 420*b* can be physically connected to a structural component 430 (e.g., the frame of the chiller 100 of FIG. 1). The controller 405 is in electrical communication with the sensor 415 such that the controller 405 receives a sensed value from the sensor 415. The controller 405 is also in electrical communication with the isolating member 420*b* such that that the controller can control a function of the isolating member 420*b*. In an embodiment, the sensor 415 is in direct contact with the vibration source 410. In an embodiment, the sensor 415 may be disposed in a location that is in contact with the structural component 430 such that vibrations from the vibration source 410 are sensed based on vibration of the structural component 430.

The sensor 415 can be selected to determine a vibration of the structural component 430, which is provided to the controller 405. For example, in an embodiment, the sensor 415 can be an accelerometer or the like. The controller 405 can control the isolating member 420*b* to provide a vibration at a resonance that will cancel some or substantially all of the vibration caused by the vibration source 410. In this manner, the system 400 can actively dampen vibration and/or pulsation caused by the vibration device 410.

In an embodiment, the controller 405 can be electrically connected to the vibration source 410 such that the vibration source 410 is also controlled by the controller 405.

Generally, embodiments disclosed in this specification can include providing one or more isolating members to prevent and/or reduce vibration/pulsation of the vibration source (e.g., a compressor) from being transmitted to other structural/functional components in a system (e.g., a refrigerant pipe, a frame of a chiller system). Embodiments as disclosed can also include providing a sound enclosure to prevent and/or reduce sound radiated from the vibration source. It is to be appreciated that the embodiments as disclosed can also be applied to other suitable vibration sources that can transmit and/or radiate the vibration, such as for example, a pump, a turbo compressor, a motor, or the like. It is also to be appreciated that the external isolation system can be configured so that vibration/pulsation and the sound created by the vibration/pulsation can be directed in a desired direction.

Aspects:

Any one of aspects 1-6 can be combined with any one of aspects 7-11 and/or any one of aspects 12-17. Any one of aspects 7-11 can be combined with any one of aspects 12-17.

Aspect 1. An external isolation system for a vibration source, comprising:

a sound enclosure configured to surround the vibration source so as to reduce sound radiated from the vibration source;

a structural isolating member configured to support the vibration source and passively damp vibrations and/or pulsations; and a functional isolating member configured to maintain a functional connection with the vibration source.

Aspect 2. The external isolation system of aspect 1, wherein the functional isolating member includes a muffler equipped to a working fluid port of the vibration source.

Aspect 3. The external isolation system of any one of aspects 1-2, wherein the functional isolating member includes an isolating conduit equipped to a working fluid port of the vibration source, and the isolating conduit is configured to allow a working fluid to pass through.

Aspect 4. The external isolation system of any one of aspects 2-3, wherein the working fluid port includes a discharge port of the vibration source or a suction port of the vibration source.

Aspect 5. The external isolation system of any one of aspects 1-4, wherein the vibration source includes a screw compressor.

Aspect 6. The external isolation system of any one of aspects 1-5, wherein the functional isolating member includes a bellow-like region.

Aspect 7. A method of providing external sound control to a vibration source, comprising:

reducing vibration transmission between a vibration source and a functional component;

reducing vibration transmission between the vibration source and a support structure supporting the vibration source; and reducing sound radiated from the vibration source.

Aspect 8. The method of aspect 7, wherein the reducing vibration transmission between a vibration source and a functional component includes a passive vibration and/or pulsation damping device.

Aspect 9. The method of any one of aspects 7-8, wherein the reducing vibration transmission between the vibration source and the support structure supporting the vibration source includes one of a passive vibration and/or pulsation damping device or an active vibration and/or pulsation damping device.

Aspect 10. The method of any one of aspects 7-9, wherein the vibration source is a compressor.

Aspect 11. The method of aspect 10, wherein the compressor is in a chiller system of a heating, ventilation, and air conditioning (HVAC) system.

Aspect 12. An external isolation system for a heating, ventilation, and air conditioning (HVAC) unit, comprising:

a sound enclosure configured to surround a compressor so as to reduce sound radiated from the compressor;

a structural isolating member configured to support the compressor and actively damp vibrations and/or pulsations; and a functional isolating member configured to maintain a functional connection with the compressor.

Aspect 13. The external isolation system of aspect 12, wherein the functional isolating member includes a muffler equipped to a working fluid port of the compressor.

Aspect 14. The external isolation system of any one of aspects 12-13, wherein the functional isolating member includes an isolating conduit equipped to a working fluid port of the compressor, and the isolating conduit is configured to allow a working fluid to pass through.

Aspect 15. The external isolation system of any one of aspects 13-14, wherein the working fluid port includes a discharge port of the compressor or a suction port of the compressor.

Aspect 16. The external isolation system of any one of aspects 12-15, wherein the compressor includes a screw compressor.

Aspect 17. The external isolation system of any one of aspects 12-16, wherein the functional isolating member includes a bellow-like region.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What is claimed is:

1. A heating, ventilation, and air conditioning (HVAC) unit comprising:

a screw compressor including a working fluid port, the working fluid port including a discharge port or a suction port;

a muffler integrated as a part of the screw compressor;

an oil separator; and an external isolation system, wherein the isolation system includes:

a sound enclosure configured to surround the screw compressor so as to reduce sound radiated from the screw compressor;

a structural isolating member configured to support the screw compressor and actively damp vibrations and/or pulsations; and a functional isolating member configured to maintain a functional connection with the screw compressor.

2. The HVAC unit of claim 1, wherein the functional isolating member includes an isolating conduit equipped to the working fluid port of the screw compressor, and the isolating conduit is configured to allow a working fluid to pass through.

3. The HVAC unit of claim 1, wherein the functional isolating member includes a bellow-like region.

4. The HVAC unit of claim 1, further comprising a sensor configured to determine a vibration of a structural component of the HVAC unit.

5. The HVAC unit of claim 1, wherein the structural isolating member includes an actuator.

6. The HVAC unit of claim 5, wherein the actuator is configured to actively generate a vibration/pulsation that is out of phase with respect to a vibration/pulsation from the screw compressor to attenuate the vibration/pulsation from the screw compressor.

* * * * *